US012268934B2

(12) United States Patent
Chou et al.

(10) Patent No.: US 12,268,934 B2
(45) Date of Patent: Apr. 8, 2025

(54) TRAINING SESSION SCHEDULING METHOD, DEVICE, AND NON-VOLATILE COMPUTER READABLE MEDIUM

(71) Applicant: Bomdic Inc., New Taipei (TW)

(72) Inventors: Tseng-Yun Chou, New Taipei (TW); Szu-Hong Chen, New Taipei (TW)

(73) Assignee: Bomdic Inc., New Taipei (TW)

( * ) Notice: Subject to any disclaimer, the term of this patent is extended or adjusted under 35 U.S.C. 154(b) by 180 days.

(21) Appl. No.: 18/091,419

(22) Filed: Dec. 30, 2022

(65) Prior Publication Data

US 2024/0216759 A1 Jul. 4, 2024

(51) Int. Cl.
*A63B 24/00* (2006.01)

(52) U.S. Cl.
CPC ..... *A63B 24/0062* (2013.01); *A63B 24/0075* (2013.01); *A63B 2024/0065* (2013.01); *A63B 2220/17* (2013.01)

(58) Field of Classification Search
CPC ..... A63B 24/0062; A63B 24/0075; A63B 2024/0065; A63B 2220/17
See application file for complete search history.

(56) References Cited

U.S. PATENT DOCUMENTS

| | | | | |
|---|---|---|---|---|
| 2017/0263147 | A1* | 9/2017 | King | G11B 27/026 |
| 2018/0036591 | A1* | 2/2018 | King | H04N 5/76 |
| 2020/0179757 | A1* | 6/2020 | Toivonen | G16H 10/20 |
| 2021/0308522 | A1* | 10/2021 | Booher | G16H 20/30 |
| 2022/0401794 | A1* | 12/2022 | Bissonnette | G06N 20/00 |
| 2024/0075343 | A1* | 3/2024 | Young | A63B 24/0006 |

FOREIGN PATENT DOCUMENTS

| | | | |
|---|---|---|---|
| TW | 201532648 | A | 9/2015 |
| TW | M587309 | U | 12/2019 |

* cited by examiner

*Primary Examiner* — Andrew S Lo

(57) ABSTRACT

A training session scheduling method, device, and non-volatile computer readable medium are provided. The method includes: sensing a maximum ability value of a test exercise item; estimating a fitness score of the user according to the maximum ability value; arranging a training exercise item schedule of a training session according to the fitness score; sensing a training intensity value of the training exercise item performed by the user during the training time; estimating a unit intensity value of the training exercise item in the unit time according to the training intensity value; comparing the unit intensity value with a preset intensity value corresponding to the training exercise item; updating the preset intensity value of the training exercise item and updating the maximum ability value of the training exercise item; and estimating the fitness score according to the updated maximum ability value.

10 Claims, 2 Drawing Sheets

TRAINING SESSION SCHEDULING METHOD, DEVICE, AND NON-VOLATILE COMPUTER READABLE MEDIUM

FIELD OF THE INVENTION

The invention relates to a training session scheduling method, a training session scheduling device, and a non-volatile computer reading medium.

BACKGROUND OF THE INVENTION

Currently, exercise training sessions from easy to difficult sessions are arranged by assistants or systems; however, there is no technology so far to dynamically adjust the difficulty of sessions in real time and gradually based on the physical condition of users, which results the users receiving inappropriate training sessions and being unable to complete the training sessions or even if completed, not achieving the desired effect.

SUMMARY OF THE INVENTION

The invention provides a training session scheduling method, a device, and a non-volatile computer reading medium, which can dynamically adjust training sessions gradually referring to the physical state of a user.

An embodiment of the present invention provides a training session scheduling method executed by a processing circuit. The training session scheduling method comprises: sensing, through a sensing circuit, a maximum ability value of a test exercise item performed by a user during a unit time; estimating a fitness score of the user according to the maximum ability value; arranging a training exercise item schedule of a training session according to the fitness score, wherein the training exercise item schedule comprises at least one training exercise item and a corresponding training time; sensing, through the sensing circuit, a training intensity value of the training exercise item performed by the user during the training time; estimating a unit intensity value of the training exercise item in the unit time according to the training intensity value; comparing the unit intensity value with a preset intensity value corresponding to the training exercise item; in response to determining that the unit intensity value is greater than the preset intensity value, updating the preset intensity value of the training exercise item and updating the maximum ability value of the training exercise item; and estimating the fitness score according to the updated maximum ability value, so as to update the training exercise item schedule of the training session according to the updated fitness score.

An embodiment of the present invention provides a training session scheduling device, which comprises a sensing circuit and a processing circuit. The sensing circuit is arranged to sense the intensity value of an exercise item. The processing circuit is coupled to the sensing circuit and arranged to execute a training session scheduling method. The training session scheduling method comprises following steps: sensing, through a sensing circuit, a maximum ability value of a test exercise item performed by a user during a unit time; estimating a fitness score of the user according to the maximum ability value; arranging a training exercise item schedule of a training session according to the fitness score, wherein the training exercise item schedule comprises at least one training exercise item and a corresponding training time; sensing, through the sensing circuit, a training intensity value of the training exercise item performed by the user during the training time; estimating a unit intensity value of the training exercise item in the unit time according to the training intensity value; comparing the unit intensity value with a preset intensity value corresponding to the training exercise item; in response to determining that the unit intensity value is greater than the preset intensity value, updating the preset intensity value of the training exercise item and updating the maximum ability value of the training exercise item; and estimating the fitness score according to the updated maximum ability value, so as to update the training exercise item schedule of the training session according to the updated fitness score.

An embodiment of the present invention provides a non-volatile computer reading medium for storing a program code, wherein the program code is read by a processing circuit to execute a training session scheduling method comprising: sensing, through a sensing circuit, a maximum ability value of a test exercise item performed by a user during a unit time; estimating a fitness score of the user according to the maximum ability value; arranging a training exercise item schedule of a training session according to the fitness score, wherein the training exercise item schedule comprises at least one training exercise item and a corresponding training time; sensing, through the sensing circuit, a training intensity value of the training exercise item performed by the user during the training time; estimating a unit intensity value of the training exercise item in the unit time according to the training intensity value; comparing the unit intensity value with a preset intensity value corresponding to the training exercise item; in response to determining that the unit intensity value is greater than the preset intensity value, updating the preset intensity value of the training exercise item and updating the maximum ability value of the training exercise item; and estimating the fitness score according to the updated maximum ability value, so as to update the training exercise item schedule of the training session according to the updated fitness score.

By adopting the training session scheduling method, the present invention can dynamically adjust the training session in real time and gradually referring to the physical condition of a user, so as to provide training sessions that are more suitable for users.

In order to make the above and other objects, features and advantages of the present invention more obvious and easier to understand, the following illustrate the detailed description of preferred embodiments with the accompanying drawings.

DETAILED DESCRIPTION OF PREFERRED EMBODIMENTS

First of all, it should be noted that in the embodiment of the present invention, the coupling modes comprise direct electrical connection as well as electrical connection through other components, modules or devices. The term "coupling"

appearing in the following article comprises the above definition, and this fact will not further mentioned in the following text.

Figure 1:
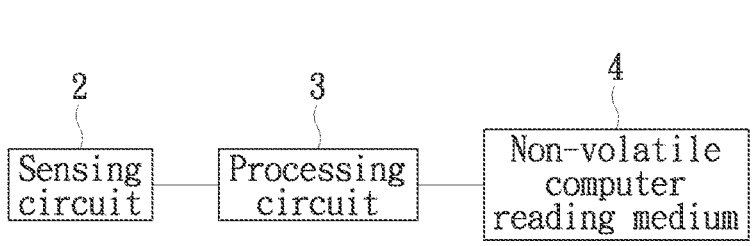
FIG. 1 is a block diagram of a system of a training session scheduling device according to an embodiment of the present invention.

Referring to FIG. 1, FIG. 1 is a block diagram of a system of a training session scheduling device according to an embodiment of the present invention. The training session scheduling device 1 provided by the present invention comprises a sensing circuit 2, a processing circuit 3 coupled to the sensing circuit 2, and a non-volatile computer reading medium 4 coupled to the processing circuit 3, wherein the sensing circuit 2 is used for sensing the intensity value of an exercise item performed by a user, and the non-volatile computer reading medium 4 stores a program code and may read the program code through the processing circuit 3 to execute the training session scheduling method. Note that the sensing circuit 2 may be a wearable device or an electronic device comprising at least one of the functions of an accelerometer and gyroscope. For example, the processing circuit 3 may be a smart phone, a tablet, a computer and a cloud server, and the non-volatile computer reading medium 4 may be a flash memory and a hard disk in a smart phone, a tablet, a computer and a cloud server. The processing of the sensing circuit 2, the circuit 3 and the non-volatile computer reading medium 4 are not specifically limited to using the same device or different devices. Exercise items may comprise push-ups, belly rolls, squats or other unarmed or non-unarmed weight training or other types of trainings. The intensity value comprises the repetitions, the maximum ability count and the training ability ratio, in which the repetitions can be realized as how many times the user performs an exercise item in a unit time, e.g., 13 times of push-ups, 14 times of belly rolls and 60 times of squats in one minute. The maximum ability count is the maximum times the user tries his/her best doing an exercise item in unit time. The training ability ratio is a ratio calculated based on the times the user does an exercise item in training time and the maximum times the user can perform on one exercise item in the unit time. Furthermore, based on the maximum ability count of the plurality of sensed test exercise items in a unit time, e.g., one minute, the processing circuit 3 can calculate the maximum ability count of users doing other exercise items in the unit time according to the cloud big data and a system-recommended algorithm. Said other exercise items may comprise but not limited to 19 exercise items: the Mountain Climber, Sit-ups, Bobby jumping, Lunge jumping, One-legged push-ups, Opening and Closing jumping, etc. For example, an exercise item may comprise is 58 climber, 9 sit-ups, 15 bobby jumps, 27 lunges, 3 push-ups, 70 opening and closing jumps, etc.

In addition, the non-volatile computer reading medium 4 further stores information corresponding to an exercise item and a plurality of ability percentages, such as a lookup table comprising a plurality of ability percentages corresponding to a plurality of test exercise items, wherein the plurality of ability percentages may comprise, but not limited to, the upper limb percentage, core percentage, lower limb percentage or aerobic percentage. For example, the Mountain Climber may contribute: 0% upper limbs, 72% core, 8% lower limbs, 20% aerobic; the sit-ups may contribute: 0% upper limbs, 100% core, 0% lower limbs, 0% aerobic; the Bobby jumping may contribute: 0% upper limb, 20% core, 0% lower limb, 80% aerobic; the Lunge jump may contribute: 0% upper limb, 14% core, 56% lower limb, 30% aerobic; One-legged push-ups may contribute: 100% upper limbs, 0% core, 0% lower limbs, 0% aerobic; the Opening jump may contribute: 3% upper limbs, 3% core, 4% lower limbs, 90% aerobic. In one embodiment, the corresponding information between the exercise items and a plurality of ability percentages can also be stored in a cloud database.

Figure 2:
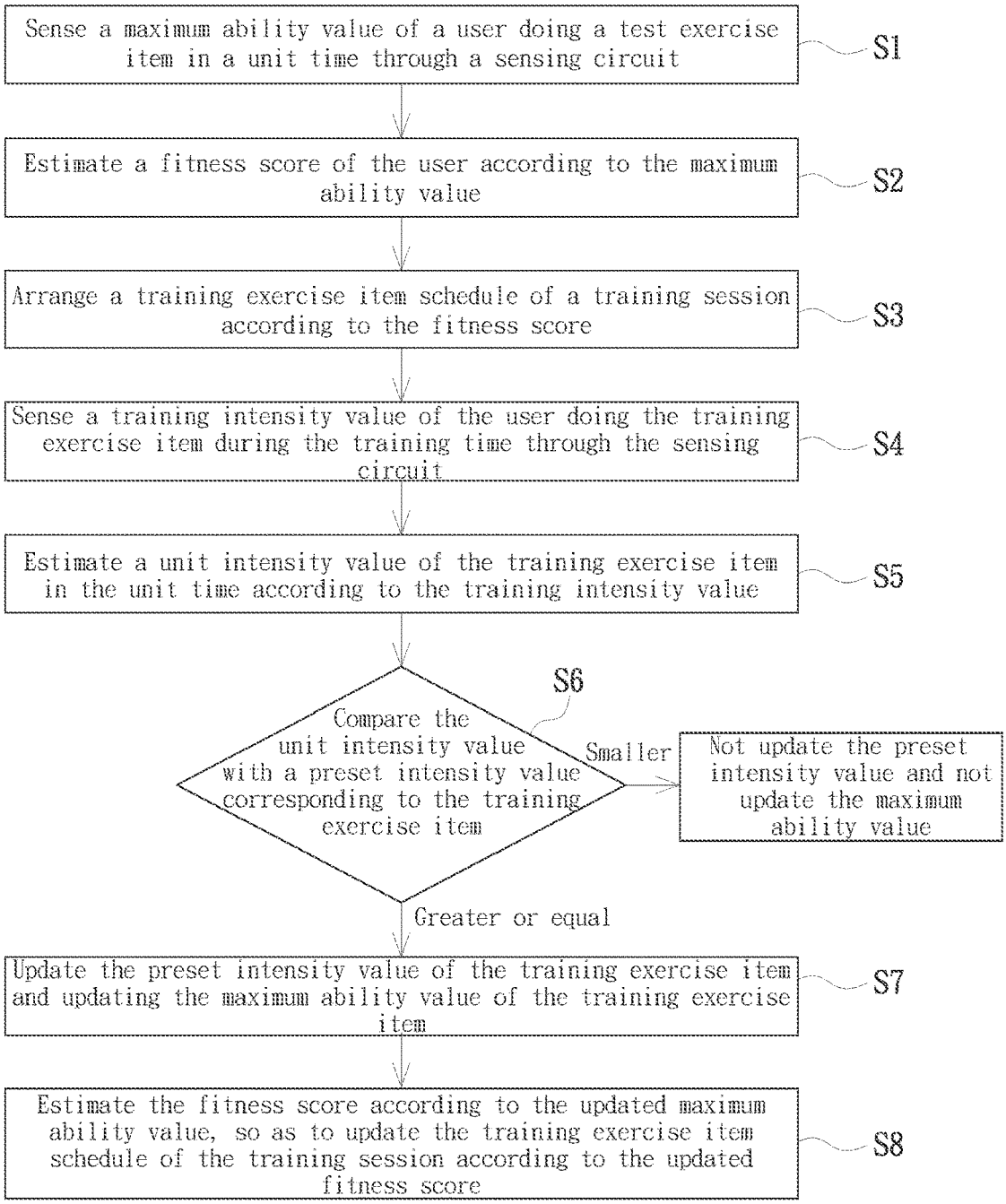
FIG. 2 is a flowchart illustrating a training session scheduling method according to an embodiment of the present invention.

Referring to FIG. 2, FIG. 2 is a flowchart illustrating a training session scheduling method according to an embodiment of the present invention. The training session scheduling method provided by the invention comprises the following steps. In Step S1, the sensing circuit 2 senses a plurality of maximum ability values, such as maximum ability counts, of a plurality of test exercise items of a user in a unit time. Specifically, the processing circuit 3 senses the maximum ability count the user can do on a test exercise item such as push-ups, belly rolls and squats in a unit time (e.g., may be 1 or 1.5 minutes) through the sensing circuit 2, and calculates the maximum ability count the user can do other exercise items in a unit time based on the maximum ability count the test exercise items can be done in a unit time.

Figure 3:
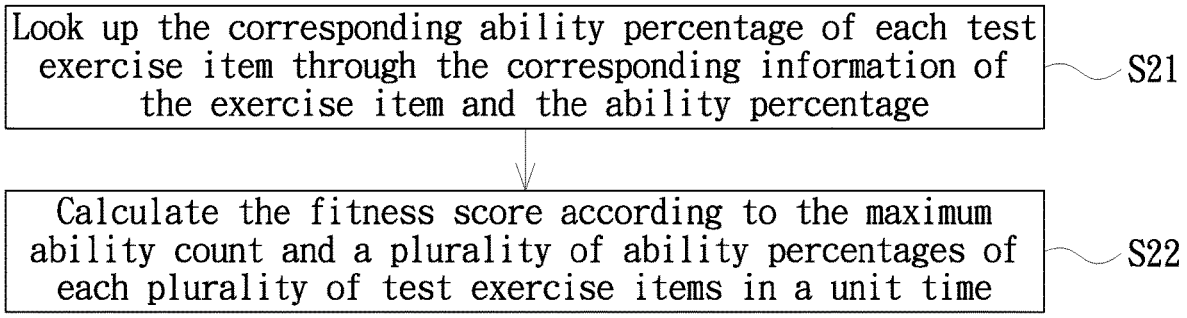
FIG. 3 is a flowchart illustrating the estimation of a fitness score according to an embodiment of the present invention.

In Step S2, the processing circuit 3 estimates the fitness score according to a plurality of maximum ability values, wherein the fitness score of the user is calculated according to the maximum ability count of the user performing a plurality of test exercise items in a unit time and the corresponding plurality of ability percentages. Specifically, as shown in FIG. 3, Step S2 comprises Step S21: Look up the corresponding ability percentage of each test exercise item through the corresponding information between the exercise item and the ability percentage, such as a lookup table; and Step S22: Calculate the fitness score according to the maximum ability count and a plurality of ability percentages of each plurality of test exercise items in a unit time. Specifically, the processing circuit 3 may obtain the fitness score based on the maximum number of ability times and a plurality of ability percentages of a plurality of test exercise items in a unit time. In an embodiment, e.g., the maximum ability count of a plurality of test exercise items in a unit time can be multiplied by a plurality of ability percentages to obtain a fitness score. For example, if the maximum ability count of push-ups are 13 times in one minute, the maximum ability count of belly rolls are 14 times in one minute, and the maximum ability count of squats are 60 times in one and a half minutes, The percentage of upper limbs, core, lower limbs and aerobic ability are push-ups: upper limbs 90%, core 10%, lower limbs 0%, aerobic ability 0%, abdomen rolling: upper limbs 0%, core 100%, lower limbs 0%, aerobic ability 0%, squat: upper limbs 0%, core 0%, lower limbs 80% and aerobic ability 20%. 530 (13×10+14×100), 4,800 (60×80) and 1,200 (60×20) respectively. In another embodiment, e.g., the maximum ability count of a plurality of test exercise items in a unit time can be multiplied by a plurality of ability percentages and then standardized to obtain a fitness score. For example, if the upper-limb score is 1,170, the core score is 1,530, the lower-limb score is 4,800, and the aerobic score is 1,200 after product (i.e., multiplication), the product score of each ability can be further standardized through big data in a database. For example, according to the ranking of the product score in big data, the fitness score is standardized to 0 to 100, and thus that the upper-limb score is 10, the core score is 23, the lower-limb score is 33, and the aerobic score is 40 after the above-mentioned fitness score is standardized. In Step S3, the processing circuit 3 arranges the exercise schedule of the training session according to the fitness score of the user, as shown in Table 1, where the first column "Function" represents the function of training at this stage; the second column "Exercise item" represents the exercise items comprised in this stage of training; the third column "Training time" represents how many times the user does this item; the fourth column "Target ability ratio" represents the degree of effort required by the user to do each set of exercise items, e.g., 50% means that the user needs to do this set of exercise items with 50% of his/her ability, and 100% means that the user does this set of exercise items with the most effort; the fifth column "Number of Sets" represents the number of sets to be done in this exercise item.

TABLE 1

| Function | Exercise item | Training time (seconds) | Target ability ratio | Number of sets |
|---|---|---|---|---|
| Warming up | Jumping Jack | 30 | NA | NA |
| | Rest | 10 | NA | NA |
| | Run on the spot | 30 | NA | NA |
| | Rest | 20 | NA | NA |
| Training combination | Push-ups | 30 | 50%, 80%, 80%, 80% | 4 |
| | Rest | 10 | NA | |
| | Belly rolling | 30 | 50%, 80%, 80%, 80% | |
| | Rest | 10 | NA | |
| | Forward lunge | 30 | 80%, 80%, 80%, 80% | |
| | Rest | 10 | NA | |
| | Jumping Jack | 30 | 50%, 80%, 80%, 80% | |
| | Rest | 10 | NA | |
| Cooling down | Walk on the spot | 60 | NA | NA |

Refer again to FIG. 2. In Step S4, when the user executes the training session in Table 1, the processing circuit 3 senses, through the sensing circuit 2, the training intensity values of the training exercise items during the training time of the user, and the training intensity values may comprise the repetitions and the training ability ratio in the training time, as shown in Table 2, where the third column "Repetitions in each set of training time" represents how many times the user does exercise items in each set of training time; the fourth column "training ability ratio" represents a ratio calculated based on the repetitions in each set of training time and the maximum ability count in unit time.

TABLE 2

| Function | Exercise item | Repetitions in each set of training times | Training ability ratio |
|---|---|---|---|
| Warming up | Jumping Jack | NA | NA |
| | Rest | NA | NA |
| | Run on the spot | NA | NA |
| | Rest | NA | NA |
| Training combination | Push-ups | 3, 5, 6, 9 | 48%, 79%, 86%, 93% |
| | Rest | NA | NA |
| | Belly rolling | 3, 6, 7, 9 | 46%, 83%, 90%, 100% |
| | Rest | NA | NA |
| | Forward lunge | 17, 18, 18, 20 | 85%, 87%, 87%, 92% |
| | Rest | NA | NA |
| | Jumping Jack | 27, 33, 31, 30 | 87%, 93%, 90%, 91% |
| | Rest | NA | NA |
| Cooling down | Walk on the spot | NA | NA |

In Step S5, the processing circuit 3 estimates the unit intensity value of at least one training exercise item in unit time according to the training intensity value of at least one training exercise item in training time, wherein the unit time is usually longer than the training time, and the unit intensity value is usually higher than the training intensity value. Specifically, in one embodiment, taking the case of push-ups as an example, in the first set of training, the sensing circuit 2 senses the data of the first set of push-ups for three times within 30 seconds of training time, once within 15 seconds before the first section time and twice after the second section time. Because the number of repetitions in the second section time is twice greater than that in the first section time, the repetitions per unit time of 1 minute can be estimated using a multiple. In the third set of training, the sensing circuit 2 senses the data of the third set of push-ups for 6 times in the training time of 30 seconds, 3 times in the first 15 seconds and 3 times in the second 15 seconds. Since the repetitions in the second zone are equal to the repetitions in the first zone, the repetitions in the third and fourth zones are estimated to be 3 times, and thus the estimated repetitions per unit time are 3+3+3+3=12 times. In the fourth set of training, the sensing circuit 2 senses the data of the fourth set of push-ups for 9 times in the training time of 30 seconds, 5 times in the first 15 seconds and 4 times in the second 15 seconds. Because the repetitions in the second zone are 4 times, which are less than those in the first zone (i.e., 5 times), the repetitions per unit time of 1 minute are estimated in a decreasing manner. For example, four times in the second section time of 15 seconds is less than five times in the first section time of 15 seconds, and thus it is estimated that the third section time of 15 seconds is 4-1-3 times, and the fourth section time of 15 seconds is 3−1=2 times, and thus the estimated repetitions per unit time are 5+4+3+2=14 times. If the number of segment times is less than 0 due to decreasing calculation, it is estimated to be 0. The estimation method of times per unit time described in the above embodiments is only for illustrative purposes, and the present invention is not limited thereto.

In an embodiment, the training ability ratio can be calculated by: (Estimated times per unit time/maximum ability count×100%+target ability ratio)/2. Taking push-ups as example, the training ability ratio of the first set is (6/13×100%+50%)/2=48%, the second set is 79%, the third set is 86%, and the fourth set is 93%. In another embodiment, the training ability ratio can be calculated by, (Estimated repetitions per unit time/the maximum ability count)×100%. Taking push-ups as example, the training ability ratio of the first set is 6/13×100%-46%, the second set is 77%, the third set is 92%, and the fourth set is 108%.

In, Step S6, the processing circuit 3 compares the unit intensity value in unit time with a preset intensity value corresponding to at least one exercise item. In one embodiment, the unit intensity value can be, the training ability ratio mentioned above. The preset intensity value can be a preset judgment standard preset by the system or customized by the user, comprising, e.g., the maximum ability value of the user, such as the maximum ability count and/or the preset ability ratio. Taking push-ups as an example, the preset intensity value comprises the maximum ability count of 13 times and the preset ability ratio of 80%, and the processing circuit 3 compares the unit intensity value of each set of push-ups with the preset intensity value.

In Step S7, when the unit intensity value is greater than or equal to the preset intensity value, the processing circuit 3 updates the preset intensity value. In an embodiment, when one set of unit intensity values of an exercise item is greater than or equal to the preset intensity value, that is, the estimated repetitions per unit time are greater than or equal to the maximum ability count and the training ability ratio is greater than or equal to the preset ability ratio, the preset intensity value is updated. Specifically, taking push-ups as an example, the repetitions per unit time of the first and second sets are 6 and 10 times respectively, both less than the maximum ability of 13 times, and the training ability ratios of 48% and 79% are less than the preset ability ratio of 80%. In the third set, although the training ability ratio is 86%, which is greater than the preset ability ratio of 80%, the repetitions of 12 times per unit time are less than the maximum ability repetitions of 13 times, and thus the results calculated based on the first, second and third sets of data do not update the preset intensity values. In the fourth set, the number of repetitions per unit time is 14 times which is greater than the maximum ability count of 13 times, and the training ability ratio is 93% which is greater than the preset ability ratio of 80%. Therefore, based on the calculation result of the fourth set of data, the processing circuit 3 updates the maximum ability count and then updates the preset intensity value, e.g., updating the maximum ability count in the preset intensity value of push-ups to 14 times per unit time. In another embodiment, the preset intensity value can be the maximum ability value only or the preset ability ratio only, so as to compare the data of exercise events and judge whether to update the maximum ability value to update the preset intensity value.

Regarding Step S8, in one embodiment, the processing circuit 3 updates the fitness score according to the updated maximum ability count, and updates the exercise item schedule of the training session according to the updated fitness score. Specifically, the processing circuit 3 calculates the data of a plurality of test exercise items in Table 2 according to the above-mentioned embodiment, and obtains the updated maximum ability count of each exercise item, and calculates the updated fitness score according to the updated maximum ability count of each exercise item, e.g., the upper-limb score is 12 (which is considered remaining the status quo), the core score is 24 (which is considered making a progress), the lower-limb score is 33 (which is considered making a progress), and the aerobic score is 40 (which is considered remaining the status quo). Next, the processing circuit 3 updates the exercise schedule of the training session according to the fitness score updated by the user, as shown in Table 3.

TABLE 3

| Function | Exercise item | Training time (sec) | Ability (upper limbs, core, lower limbs, aerobic) | Set count |
|---|---|---|---|---|
| Warming up | Jumping Jack | 30 | NA | NA |
| | Rest | 10 | NA | NA |
| | Run on the spot | 30 | NA | NA |
| | Rest | 20 | NA | NA |
| Training combination | Push-ups | 35 | 50%, 80%, 80%, 100% | 4 |
| | Rest | 10 | NA | |
| | Belly rolling | 30 | 50%, 80%, 80%, 100% | |
| | Rest | 10 | NA | |
| | Forward lunge | 30 | 80%, 80%, 80%, 80% | |
| | Rest | 10 | NA | |
| | Jumping Jack | 30 | 50%, 80%, 80%, 100% | |
| | Rest | 10 | NA | |
| Cooling down | Walk on the spot | 60 | NA | NA |

To sum up, with the provision of the training session scheduling method, the present invention may dynamically adjust the training session in real time and a gradual manner according to the physical condition of the user, so as to provide a training session more suitable for the user.

Although the present invention has been disclosed by way of example, it is not intended to limit the present invention. Those with ordinary knowledge in the technical field to which the present invention belongs can make some changes and embellishments without departing from the spirit and scope of the present invention. Therefore, the scope of protection of the present invention should be determined by the appended patent application.

What is claimed is:

1. A training session scheduling method executed by a processing circuit, comprising:

sensing, through a sensing circuit, a maximum ability value of a test exercise item performed by a user during a unit time;

estimating a fitness score of the user according to the maximum ability value;

arranging a training exercise item schedule of a training session according to the fitness score, wherein the training exercise item schedule comprises at least one training exercise item and a corresponding training time;

sensing, through the sensing circuit, a training intensity value of the training exercise item performed by the user during the training time;

estimating a unit intensity value of the training exercise item in the unit time according to the training intensity value;

comparing the unit intensity value with a preset intensity value corresponding to the training exercise item;

in response to determining that the unit intensity value is greater than the preset intensity value, updating the preset intensity value of the training exercise item and updating the maximum ability value of the training exercise item; and estimating the fitness score according to the updated maximum ability value to update the training exercise item schedule of the training session according to an updated fitness score.

2. The method of claim 1, wherein the step of estimating the fitness score of the user according to the maximum ability value comprises:

looking up an ability percentage of the test exercise item according to corresponding information between an exercise item and an ability percentage; and calculating the fitness score according to the maximum ability value and the ability percentage of the test exercise item in the unit time.

3. The method of claim 2, wherein the corresponding information between the exercise item and the ability percentage is a lookup table.

4. The method of claim 2, wherein the ability percentage comprises upper limb percentage, core percentage, lower limb percentage and aerobic percentage; and the fitness score comprises upper-limb score, core score, lower-limb score and aerobic score.

5. The method of claim 1, wherein the maximum ability value comprises a maximum ability count of the user doing the test exercise item within the unit time.

6. The method of claim 5, wherein the training intensity value comprises a first count of the user doing the training exercise item during the training time.

7. The method of claim 6, wherein the unit intensity value comprises a second count of the user doing the training exercise item during the training time calculated based on the training intensity value.

8. The method of claim 7, wherein the preset intensity value comprises the maximum ability count.

9. The method of claim 8, wherein the step of comparing the unit intensity value with the preset intensity value corresponding to the training exercise item comprises:

comparing the second count comprised in the unit intensity value with the maximum ability count comprised in the preset intensity value.

10. The method of claim 8, wherein the step of updating the maximum ability value comprises:

updating the maximum ability count of the training exercise item.

* * * * *